United States Patent [19]

Tsai et al.

[11] Patent Number: 4,794,896

[45] Date of Patent: Jan. 3, 1989

[54] LUBRICATING DEVICE FOR TWO-STROKE ENGINE

[75] Inventors: Ching-Eeng Tsai; Guang-Der Tarng, both of Hsin Chu Hsien, Taiwan

[73] Assignee: Industrial Technology Research Institute, Hsin Chu Hsien, Taiwan

[21] Appl. No.: 117,340

[22] Filed: Nov. 6, 1987

[51] Int. Cl.[4] ..... F01M 1/00

[52] U.S. Cl. ..... 123/193; 123/196 M; 123/41.39; 184/6.8

[58] Field of Search ..... 123/196 M, 193 P, 41.39; 184/6.8

[56] References Cited

U.S. PATENT DOCUMENTS 2,359,672 10/1944 Denco ..... 123/41.39

4,280,455 7/1981 Yamaguchi et al. ..... 123/196 M

FOREIGN PATENT DOCUMENTS 117844 9/1979 Japan ..... 123/196 M 117842 9/1979 Japan ..... 123/196 M

*Primary Examiner*—E. Rollins Cross

*Attorney, Agent, or Firm*—Cushman, Darby & Cushman

[57] ABSTRACT

It is a lubrication device for two-stroke gasoline engine, in which the cylinder is furnished with one to three lubricant outlets; the feature of the lubricant outlets is that the height position of the lubricant outlets is placed just under the bottom piston ring upon the piston reaching the lower dead point, but the location of the lubricant outlet can be placed on the exhaust side, the major thrust side or the minor thrust side.

4 Claims, 5 Drawing Sheets

LUBRICATING DEVICE FOR TWO-STROKE ENGINE

BACKGROUND OF THE INVENTION

Currently, there are two lubrication methods for two stroke gasoline engines, i.e., the pre-mixing method, in which a given percentage of lubricant is mixed with the gasoline; and secondly the separating lubrication method, in which the lubricant is fed into the downstream portion of carburetor by using an oil pump before being mixed with the atomized gasoline and then entering into the crankcase and the cylinder. According to the aforesaid two lubrication methods, the atomized fuel flows in a rather large space; the ratio of lubricant actually distributed on the friction surface between the piston and cylinder wall is very low; a portion of the lubricant remains in the cylinder and is not burnt completely. Upon being exhausted that portion of lubricant remaining in the cylinder causes the air to be polluted.

SUMMARY OF THE INVENTION

This invention relates to a lubrication device for an internal-combustion engine, and particularly to for a two-stroke gasoline engine. The cylinder wall is furnished with a lubricant outlet; the lubricant is fed into the cylinder wall and the piston rings via a lubricant pipe so as to lower the consumption of lubricant and to minimize the exhausting volume of lubricant for reducing the air pollution.

The primary object of the present invention is to provide a lubrication device, which can directly lubricate the cylinder wall. A lubricant outlet is furnished at a suitable position on the cylinder wall so as to feed a minimum volume of lubricant to obtain the maximum lubrication result; therefore, air pollution by the exhausted gas can be lowered considerably.

In an engine, the piston moves reciprocally; causing friction between the piston and the cylinder wall. Further, the cylinder wall suffers from high temperature and pressure generated by the combustion gas, and therefore a suitable lubrication is required. The present invention provides a lubricant directly to the cylinder wall, and the lubricant is then evenly distributed in the cylinder by means of the mutual squeezing effect between the piston and the cylinder wall. Moreover, the real essential feature of the present invention is the position selection of the lubricant outlet on the cylinder wall; a suitable position for the lubricant outlet is necessary to have the engine properly lubricated; otherwise, a scuffing take place between the piston and the cylinder; and more serious, piston seizure might occur.

Upon the piston moving back and forth, the piston ring can cause the lubricant to form a lubricant film between the piston and the cylinder wall so as to minimize the friction there between. When the piston is reached its top or bottom dead point, the linear speed of the piston is equal to zero; in that case, no lubricant film is formed, and a serious wear will take place between the piston and the cylinder wall; therefore, the position nearing the top or the bottom dead point is the suitable position for the lubricant outlet. However, if the lubricant outlet is placed in the vicinity of the top dead point, the lubricant will be in contact with the combustion gas and will fail to provide the lubrication result desired; consequently, the bottom dead point is the best position to be considered. Further, if the lubricant outlet is positioned between two piston rings, carbon might be accumulated therein to cause the piston rings to stick. Finally, it is determined that the lubricant outlet is positioned just under the lowest piston ring.

Another factor to be considered for positioning the lubricant outlet is that the lubricant pipe should not pass through the scavenging port so as to prevent the lubricant from affecting the scavenging efficiency. Thus, the thrust side and the exhaust side of the cylinder are considered the best positions. The major thrust side has greater friction force than the secondary driving force side; the exhaust side has a higher temperature; in view of the aforesaid factors, it has been determined that the major thrust side, the minor thrust side, and the exhaust side are selected as the positions for placing the lubricant outlet.

The lubrication for the other parts of the engine, such as the pistonpin, the bearings on both ends of the piston rod, and the main bearing of the crankshaft, etc. is done by means of the atomized lubricant, which is generated by using the piston to squeeze the lubricant into the crankcase, to be atomized by the crankshaft rotation, and to be transmitted by air circulation to those parts.

The volume of the lubricant can be determined through experiments by setting the diameter of the lubricant outlet, and also by setting the feeding speed of the lubricant pump in accordance with the engine speed; and the load. In other words, the lubricant volume should be set in such a manner that the cylinder should have a suitable lubrication without accumulating too much lubricant in the crankcase.

BRIEF DESCRIPTION OF THE DRAWINGS

FIG. 2 is a cross-sectional view of the embodiment of the present invention, in which FIG. 2A illustrates the lubricant outlet being furnished on the major thrust side, while

FIG. 3 illustrates the comparison of testing results between the present invention and the conventional lubrication system, in which FIG. 3A illustrates a curve diagram of the power (PS) versus the engine speed (RPM), while

DETAILED DESCRIPTION

Figure 1:
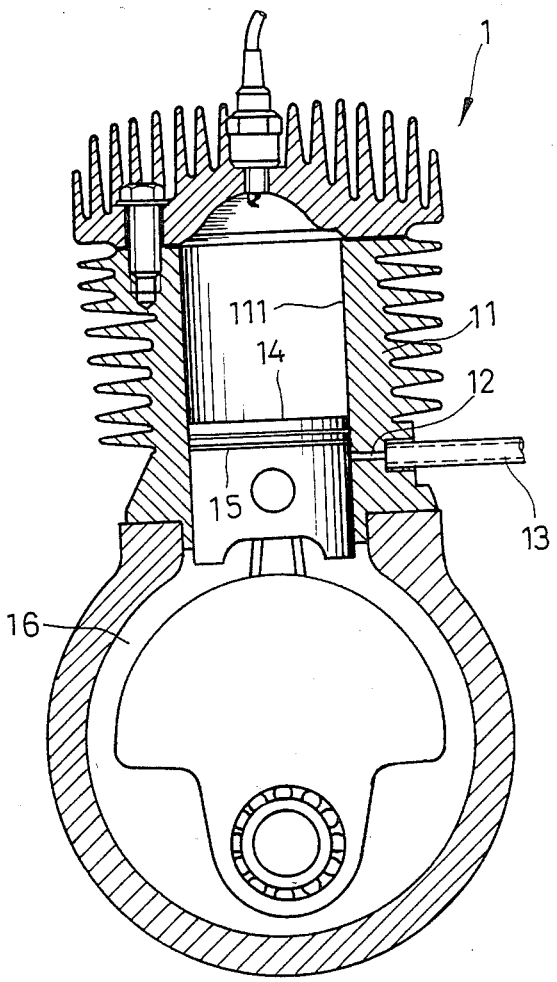
FIG. 1 is a sectional view of an engine according to the present invention.

The features and functions of the present invention are described in detail, with reference to the accompanying drawings, as follows:

FIG. 1 illustrates a sectional view of an engine according to the present invention, which shows a lubricant outlet 12 on the cylinder 11 of the two-stroke gasoline engine 1, and a lubricant pipe 13 being connected with an oil pump (not shown). The height of the lubricant outlet 12 (i.e., the relative position with the stroke of the piston) is under the lowest piston ring 15 of the bottom dead point of the piston 14 as shown in FIG. 1. The oil pump can feed lubricant to the lubricant outlet 12 when the engine running; the lubricant will evenly be distributed on the cylinder wall as a result of the squeezing effect between the piston 14 and the cylinder wall 111 to fulfill the purpose of lubrication. The remaining lubricant will fall into the crankcase 16, and will be atomized by the rotation of the crankshaft so as to lubricate the other parts in the engine.

Figure 2A:
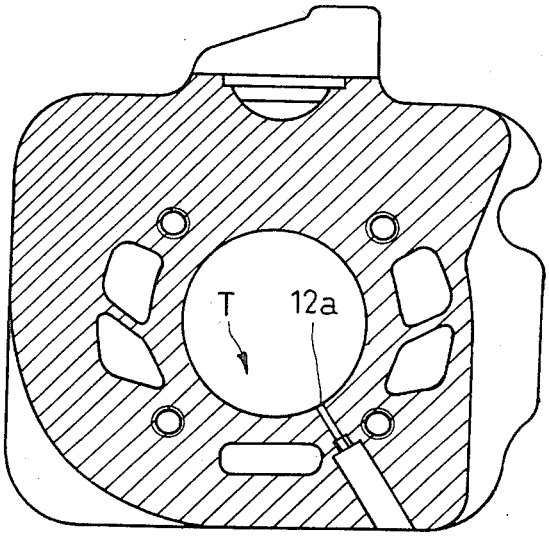
Figure 2B:
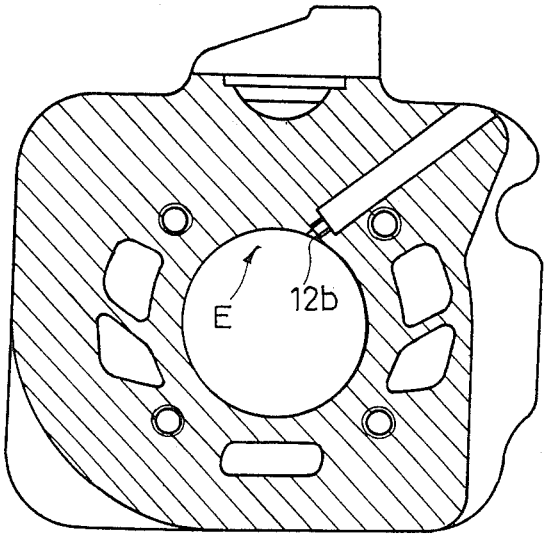
FIG. 2B illustrates the lubricant outlet being furnished on the exhaust side (also, the minor thrust side).

The present invention was experimented with a two-stroke gasoline engine (90 c.c.) mounted on a dynamometer. Each experiment was tested with another new such cylinder. Each of the aforesaid experiments was used to compare with the conventional lubricatin system of an engine. The experimental cylinder is furnished with a lubricant outlet 12 to feed lubricant directly as shown in FIG. 2A, in which the lubricant outlet 12 a is located on the major thrust side T. In FIG. 2B, another experimental cylinder has a lubricant outlet 12*b* being positioned on the exhaust side E of the cylinder, which is also the minor thrust side of the cylinder.

Before each test on a new cylinder, the engine was run for four hours; then, a full load performance test was conducted. During the test, the throttle was fully opened, and the engine speed was set in a range from 1000 rpm to 6500 rpm; the running condition was recorded upon stepping up 500 rpm, i.e. recorded the torque of the engine, the consumption rate of fuel, and consumption rate of the lubricating oil when each running speed reached a steady state.

According to the tests, a ful and adequate lubrication can be obtained by means of the cylinder wal lubricating method under a oil/fuel ratio ranging from 1.0% to 1.5%.

Figure 3A:
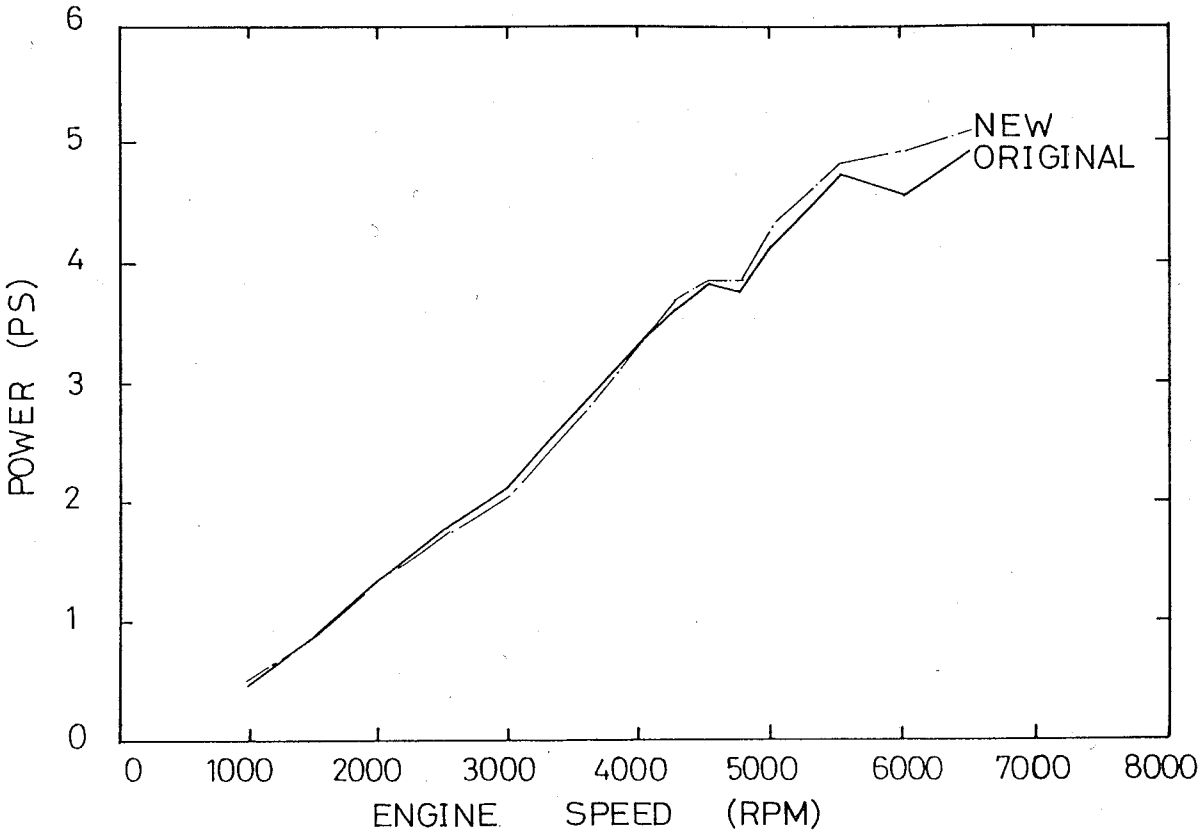
Figure 3B:
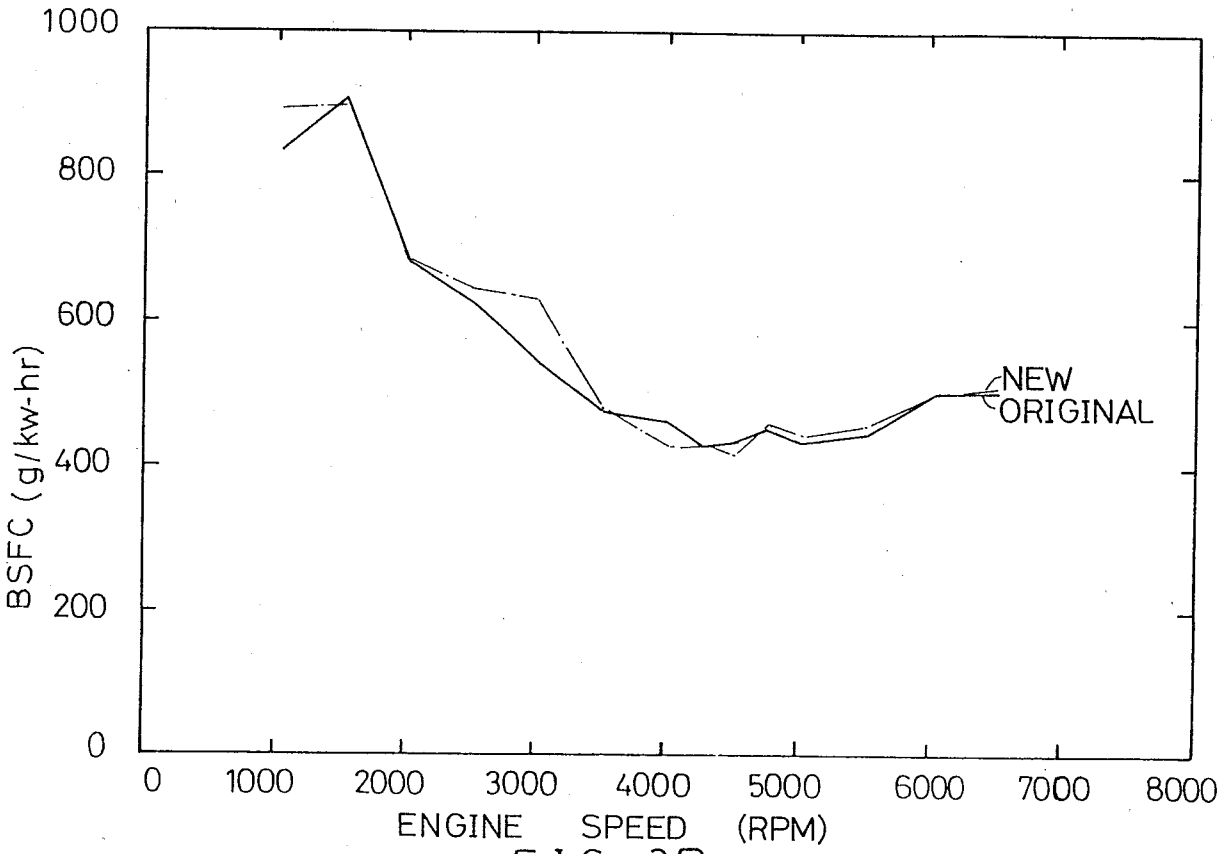
FIG. 3B shows a curve of BSFC (g/kw-hr), versus engine speed (RPM)
Figure 3C:
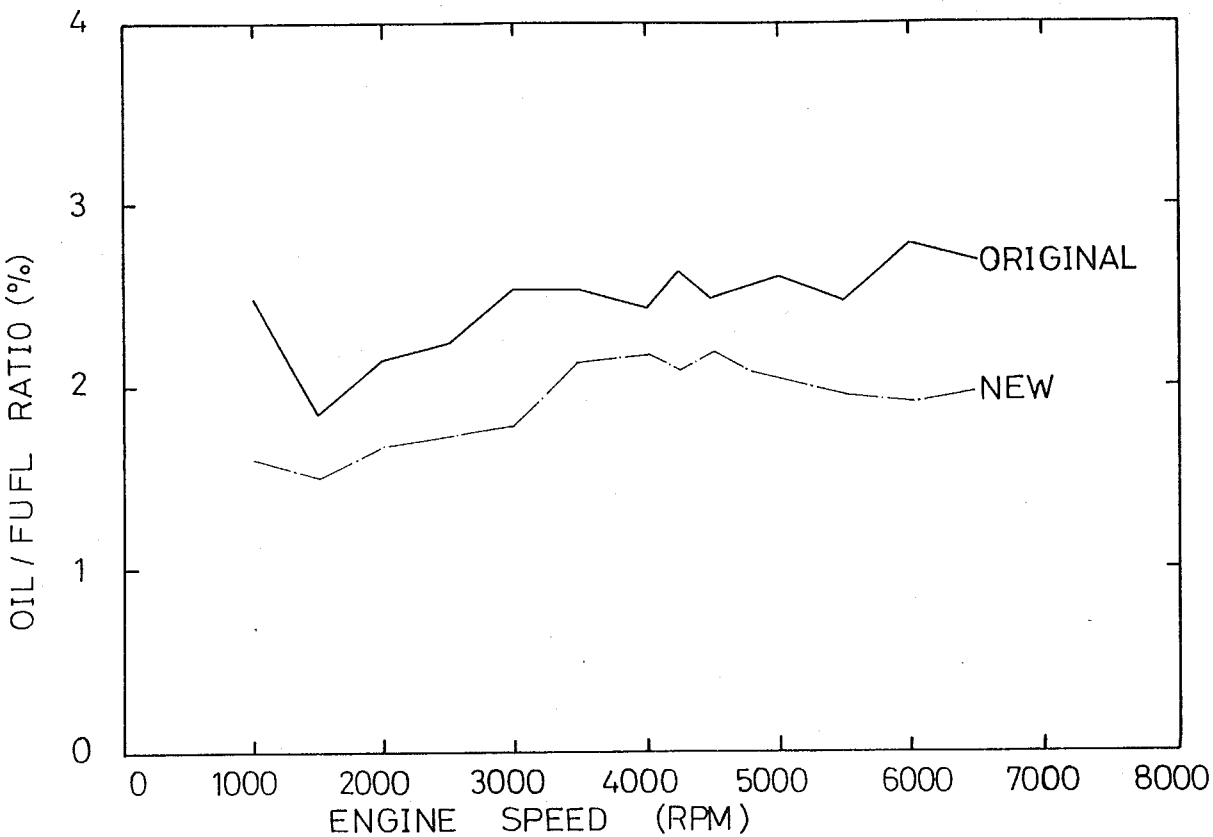
FIG. 3C shows a curve fo the oil/fuel sation (%) versue the engine speed.

FIGS. 3A, 3B and 3C indicate the aforesaid experimental results respectively, i.e., the comparison between the conventional lubrication system (indicated with solid line) and the lubrication system of the present invention (indicated with dotted line). As shown in the aforesaid Figs., similar results have been obtained when the lubricant outlet being furnished on the major thrust side or on the minor thrust side.

FIGS. 3A and 3B indicate that the horsepower and the fuel consumption between the present invention and the conventional lubrication system have no prominent difference. FIG. 3C shows the oil/fuel ratio of the present invention being lower than that of the conventional lubrication system; say it lowers about $\frac{1}{4}$.

According to the aforesaid experimental results, the present invention can save at least 25% lubricant consumption because the present invention can supply lubricant directly to the position in the engine where it is really needed and still having the engine generate the horsepower and consume the same amount of fuel designed originally. The reduction of lubricant consumption can lower the mileage cost of a car; more important, the present invention can reduce the exhaust pollution because of the present invention uses less lubricant, and generally, the lubricant is unable to burn completely during the combustion stroke. In the present invention, the lubricant outlet can be furnished on the major thrust side, the minor thrust side, and the exhaust side. In real use, the aforesaid three sides for the lubricant outlet may be overlapped (for example, the minor thrust side and the exhaust side are overlapped as shown in the embodiment mentioned above); therefore, the engine may be furnished with three lubricant outlets, or two or one lubricant outlet. Further experiments have been made according to the present invention, but there was not much difference being found upon a cylinder being furnished with multiple or one single lubricant outlet; consequently, the position and the number of the lubricant outlets can be determined in accordance with the specific condition of an engine.

We claim:

1. A lubrication device for a two-stroke gasoline engine having a cylinder as combustion chamber, a piston with piston rings, said piston disposed to reciprocate within said cylinder between a top and a bottom dead point, a piston rod connecting said piston to a crankshaft which rotates in a crankcase located below said cylinder, said lubrication device comprising:

a pump for providing lubricant;

tube means for delivering the lubricant from said pump to said engine; and at least one lubricant outlet furnished on the wall of said cylinder, the height position of said lubricant outlet being placed just under the lowest piston ring upon said piston reaching the bottom dead point, the diameter of said outlet and the feeding rate of said pump are suitably determined by the engine speed and the engine load so as to have the cylinder wall lubricated adequately by a first portion of the lubricant, and a second portion of the lubricant flowing into said crankcase without accumulating and being atomized therein by the movement of the crankshaft thereby lubricating the entire two-stroke gasoline engine.

2. A lubrication device as in claim 1, wherein said lubricant outlet is disposed on the exhaust side, on the cylinder wall.

3. A lubrication device as in claim 1 wherein said lubricant outlet is disposed on the major thrust side on the cylinder wall.

4. A lubrication device as in claim 1 wherein said lubricant outlet is disposed on the minor thrust side on the cylinder wall.

* * * * *